US011193433B2

(12) United States Patent
Yamada et al.

(10) Patent No.: US 11,193,433 B2
(45) Date of Patent: Dec. 7, 2021

(54) ENGINE CONTROLLER, ENGINE CONTROL METHOD, AND MEMORY MEDIUM

(71) Applicant: TOYOTA JIDOSHA KABUSHIKI KAISHA, Toyota (JP)

(72) Inventors: Takafumi Yamada, Okazaki (JP); Takahiro Anami, Toyota (JP); Shunsuke Kurita, Mie-ken (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/983,060

(22) Filed: Aug. 3, 2020

(65) Prior Publication Data

US 2021/0071597 A1 Mar. 11, 2021

(30) Foreign Application Priority Data

Sep. 10, 2019 (JP) ..... JP2019-164433

(51) Int. Cl.
*F02D 41/00* (2006.01)
*F02D 41/18* (2006.01)

(52) U.S. Cl.
CPC ..... *F02D 41/0002* (2013.01); *F02D 41/18* (2013.01); *F02D 2200/0404* (2013.01); *F02D 2200/0406* (2013.01)

(58) Field of Classification Search
CPC ..... F02D 41/00; F02D 41/0002; F02D 41/18; F02D 41/185; F02D 41/187; F02D 2200/0402; F02D 2200/0404; F02D 2200/0406; F02D 2400/08; G01F 1/72; Y02T 10/20
USPC ..... 701/101–103, 114
See application file for complete search history.

(56) References Cited

U.S. PATENT DOCUMENTS 4,736,725 A * 4/1988 Iwaki ..... F02D 41/18 123/480
4,773,375 A * 9/1988 Okino ..... F02D 41/04 123/488
5,537,981 A * 7/1996 Suedholt ..... F02D 41/187 123/478
5,619,974 A * 4/1997 Rodefeld ..... F02D 41/0072 123/568.23

(Continued)

FOREIGN PATENT DOCUMENTS

EP 1 698 865 A2 9/2006
JP 1-265122 A 10/1989
JP 2013-221418 A 10/2013

*Primary Examiner* — John Kwon
*Assistant Examiner* — Johnny H Hoang
(74) *Attorney, Agent, or Firm* — Oblon, McClelland, Maier & Neustadt, L.L.P.

(57) ABSTRACT

An engine controller, an engine control method, and memory medium are provided. A second calculation process calculates an intake air amount without using a detection result of an air flow meter. The determination process determines that intake air pulsation is great if it is confirmed that a difference between an average flow rate and a minimum flow rate is great. The average flow rate is an average value of an intake air flow rate within a period of the intake air pulsation. The minimum flow rate is a minimum value of the intake air flow rate within the period. When it is determined that the intake air pulsation is great, a calculation method switching process selects a calculated value of the intake air amount that is obtained by the second calculation process.

7 Claims, 5 Drawing Sheets

(56) References Cited

U.S. PATENT DOCUMENTS

| | | | | |
|---|---|---|---|---|
| 7,286,925 | B2 * | 10/2007 | Lang | G01F 1/72 701/114 |
| 2006/0212250 | A1 | 9/2006 | Kobayashi | |
| 2011/0004422 | A1 | 1/2011 | Akagi et al. | |

* cited by examiner

ENGINE CONTROLLER, ENGINE CONTROL METHOD, AND MEMORY MEDIUM

BACKGROUND

1. Field

The present disclosure relates to an engine controller that controls operation of an engine by calculating an intake air amount introduced into a cylinder and operating an actuator, such as an injector, based on the calculated value of the intake air amount.

2. Description of Related Art

Control of an operating state of an engine is performed by operating actuators such as injectors and a throttle valve. For example, control of an air-fuel ratio of air-fuel mixture burned in a cylinder is performed by determining a fuel injection amount required to bring the air-fuel ratio to a target value based on an intake air amount introduced into the cylinder and operating the injector to inject fuel of the determined fuel injection amount. Accurate acquisition of the intake air amount is necessary for improving the control accuracy of the above-described engine control, which is performed by determining an operation amount of the actuator based on the intake air amount.

Known intake air amount calculation methods include three methods: a mass flow method, a speed density method, and a throttle speed method. In the mass flow method, an intake air amount is calculated from an intake air flow rate detected by an air flow meter disposed in a section of an intake passage that is upstream of a throttle valve. In the speed density method, an intake air amount is calculated by detecting an intake pipe pressure with an intake pipe pressure sensor disposed in a section of an intake passage that is downstream of a throttle valve and using an intake air flow rate estimated based on the intake pipe pressure and an engine rotation speed. In the throttle speed method, an intake air amount is calculated from an intake air flow rate estimated based on a throttle opening degree and an engine rotation speed.

Normally, among these three calculation methods, the mass flow method most accurately calculates the intake air amount during steady operation of the engine. Since each cylinder of the engine intermittently draws intake air in accordance with opening and closing of the intake valve, the flow of intake air in the intake passage is accompanied by pulsation. Such intake air pulsation influences the detected value of the air flow meter. Thus, in engine operational zones of great intake air pulsation, the speed density method and the throttle speed method more accurately calculate the intake air amount than the mass flow method in some cases.

In this regard, Japanese Laid-Open Patent Publication No. 1-265122 discloses an engine controller that calculates an intake air amount while switching calculation methods in accordance with a magnitude of intake air pulsation. The engine controller of the document determines whether intake air pulsation is great based on an output of an air flow meter. When determining that the intake air pulsation is not great, the engine controller calculates the intake air amount by the mass flow method. When determining that the intake air pulsation is great, the engine controller calculates the intake air amount by the throttle speed method.

SUMMARY

Depending on the operating state of the engine, the intake air pulsation causes intake air to temporarily flow backward in the intake passage. In particular, in an engine that operates in Atkinson cycle by delaying the closing timing of the intake valve in relation to the compression bottom dead center, the intake air is likely to flow backwards since the intake air is pushed back to the intake passage from the cylinder after the compression bottom dead center.

The output characteristics of the air flow meter are non-linear in relation to the intake air flow rate, and the detection accuracy of the air flow meter is set be higher in more frequently used ranges of flow rate. Thus, in ranges of flow rate in which the intake air flows backward, detection errors of the air flow meter increase. Thus, when the intake air flows backward, the magnitude of the intake air pulsation cannot be accurately detected, so that the intake air amount calculation method may fail to be switched appropriately.

Examples of the present disclosure will now be described.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure provides Example 1 of an engine controller used for an engine. The engine includes an air flow meter that detects an intake air flow rate in an intake passage. The engine controller operates an actuator installed in the engine, thereby controlling operation of the engine. The engine controller executes a first calculation process that calculates an intake air amount introduced into a cylinder of the engine. The first calculation process detects the intake air amount based on a detection result of the air flow meter. A second calculation process calculates the intake air amount based on at least one of a detected value of an intake pipe pressure and a throttle opening degree, without using the detection result of the air flow meter. A determination process determines whether an intake air pulsation is great based on the intake air flow rate detected by the air flow meter. The determination process determines that the intake air pulsation is great if it is confirmed that a difference between an average flow rate and a minimum flow rate is great. The average flow rate is an average value of the intake air flow rate within a period of the intake air pulsation. The minimum flow rate is a minimum value of the intake air flow rate within the period. When the determination process does not determine that the intake air pulsation is great, a calculation method switching process selects a calculated value of the intake air amount that is obtained by the first calculation process as an intake air amount calculated value used to determine an operation amount of the actuator. When the determination process determines that the intake air pulsation is great, the calculation method switching process selects a calculated value of the intake air amount that is obtained by the second calculation process as the intake air amount calculated value used to determine the operation amount of the actuator.

The first calculation process of the above-described engine controller performs the calculation of the intake air amount by the mass flow method based on the detected value of the intake air flow rate of the air flow meter. The second calculation process performs the calculation of the intake air amount by the speed density method based on the detected value of the intake pipe pressure or by the throttle speed method. When the intake air pulsation is great, the detection accuracy of the intake air flow rate acquired by the air flow meter is reduced. Accordingly, the calculation accuracy of the intake air amount of the mass flow method is reduced.

The above-described engine controller performs the determination process that determines whether intake air pulsation is great. The engine controller switches the intake air amount calculation method, which is used to determine the operation amount of the actuator, in accordance with the magnitude of the intake air pulsation, so as to use the mass flow method when the intake air pulsation is small and the speed density method or the throttle speed method when the intake air pulsation is great.

The magnitude of the intake air pulsation can be obtained from the detection result of the intake air flow rate of the air flow meter. For example, from the detection result of the air flow meter, the whole amplitude of the fluctuation waveform of the intake air flow rate, the half amplitude of the intake air flow rate on the peak-value side, or the half amplitude of the intake air flow rate on the bottom-value side can be obtained as an evaluation value of the magnitude of the intake air pulsation. The air flow meter has output characteristics that are non-linear in relation to the intake air flow rate, and detection errors of the air flow meter increase in ranges of the flow rate in which the intake air flow rate has negative values, that is, in ranges of backward flow. Thus, when intake air pulsation that reaches a backward flow range is generated, all of the whole amplitude, the peak-side half amplitude, and the bottom-side half amplitude, which are obtained from the detection result of the air flow meter, have errors.

When a state in which intake air pulsation is generated in a range in which the intake air pulsation does not reach the backward flow range is changed to a state in which the intake air pulsation has increased to reach the backward flow range, the increase rate of the bottom-side half amplitude is greater than the increase rate of the peak-side half amplitude. Thus, the bottom-side half amplitude at the time when the intake air pulsation has increased to reach the backward flow range is large enough to exceed the amount corresponding to the errors of the air flow meter. Thus, even when intake air pulsation that reaches a backward flow range is generated, the magnitude of the intake air pulsation is determined with a certain level of accuracy by observing the bottom-side half amplitude of the fluctuation waveform of the intake air flow rate detected by the air flow meter.

In the determination process in the above-described engine controller, the intake air pulsation is determined to be great when it is confirmed that the difference between the average flow rate and the minimum flow rate within the period of the intake air pulsation, that is, the bottom-side half amplitude of the fluctuation waveform of the intake air flow rate is great. Thus, even when intake air pulsation that reaches the backward flow range is generated, the intake air amount calculation method is switched appropriately since the magnitude of the intake air pulsation is accurately determined.

In the following description, the intake air flow rate detected by the air flow meter will be referred to an AFM-detected flow rate. Until one whole period of the intake air pulsation is complete, the minimum flow rate is not determined. Thus, even if the intake air pulsation increases, a temporal delay up to the amount of time corresponding to the period of the intake air pulsation may occur until an increase in the intake air pulsation can be confirmed as the difference between the average flow rate and the minimum flow rate. On the other hand, within the period of the intake air pulsation, the difference obtained by subtracting an instantaneous value of the AFM-detected flow rate from the average flow rate is always less than or equal to the difference between the average flow rate and the minimum flow rate. Thus, the difference between the average flow rate and the minimum flow rate certainly becomes a great value at the time when the difference obtained by subtracting the instantaneous value of the AFM-detected flow rate from the average flow rate becomes a great value. Thus, as Example 2, the determination process in the above-described engine controller may confirm that the difference between the average flow rate and the minimum flow rate is great if a difference obtained by subtracting an instantaneous value of the intake air flow rate detected by the air flow meter from the average flow rate is great. This configuration promptly determines that a state in which the intake air pulsation is small has been changed to a state in which the intake air pulsation is great.

When an error occurs in a first intake air amount calculated value due to intake air pulsation, the relative magnitude of the error in relation to the intake air amount calculated value, rather than the absolute magnitude, may be a problem in some cases. In such a case, as Example 3, the determination process in the above-described engine controller may obtain, as a value of a pulsation rate, a quotient obtained by dividing the difference between the average flow rate and the minimum flow rate by the average flow rate. The determination process may also determine that the intake air pulsation is great if the pulsation rate exceeds a prescribed pulsation determination value.

When the throttle opening degree is smaller than a certain opening degree, an intake air pulsation does not occur that is great so as to reduce the calculation accuracy of the first intake air amount calculated value to a level below the permissible range. In this regard, as Example 4, after determining that the intake air pulsation is great, the determination process in the above-described engine controller may determine that the intake air pulsation is not great if the throttle opening degree falls below a prescribed small opening degree determination value. In this case, when the intake air pulsation is reduced by an abrupt closure of the throttle valve, it is determined that the intake air pulsation has become small before the reduced intake air pulsation starts affecting the difference between the average flow rate and the minimum flow rate. This configuration promptly determines that a state in which the intake air pulsation is great has been changed to a state in which the intake air pulsation is small. Further, when the throttle opening degree is reduced, the intake pipe pressure is reduced. Thus, as Example 5, after determining that the intake air pulsation is great, the determination process in the above-described engine controller may determine that the intake air pulsation is not great if the intake pipe pressure falls below a prescribed low pressure determination value. This configuration also promptly determines that a state in which the intake air pulsation is great has been changed to a state in which the intake air pulsation is small.

The minimum flow rate may be temporarily obtained as a value less than the actual value, for example, due to noise being superimposed on the output signal of the air flow meter. In this case, even if the actual intake air pulsation has not increased, the difference between the average flow rate and the minimum flow rate increases, so that it may be erroneously determined that the intake air pulsation is great. The influence of the noise is only temporary. Thus, as Example 6, when the difference between the average flow rate and the minimum flow rate remains great over two periods of the intake air pulsation, the determination process in the above-described engine controller may determine that the intake air pulsation is great. This configuration prevents erroneous determinations as described above.

Example 7: An engine control method is provided that performs the various processes described in any one of the above Examples.

Example 8: A non-transitory computer readable memory medium is provided that stores a program that causes a processing device to perform the various processes described in any one of the above Examples.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

Figure 1:
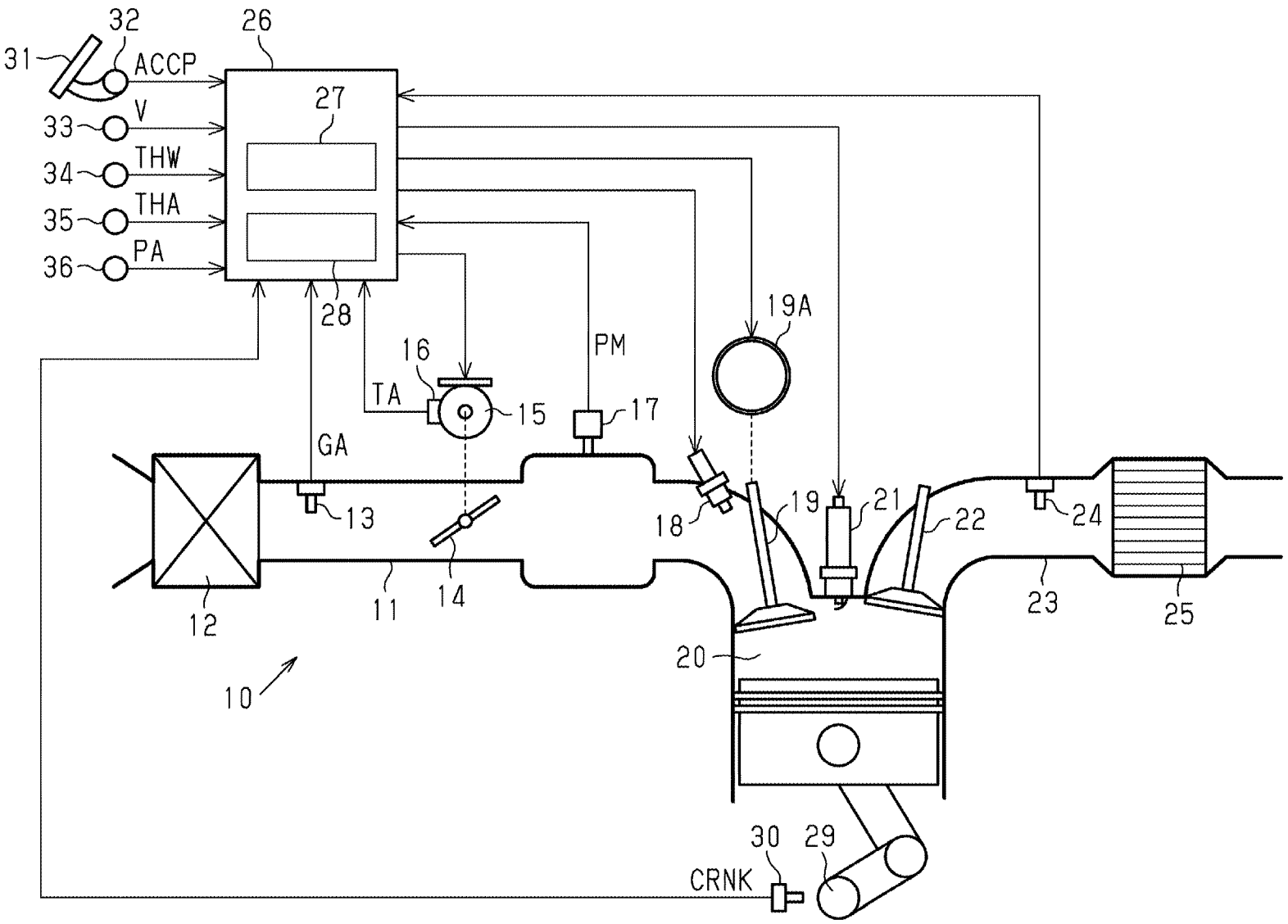
FIG. 1 is a schematic diagram showing an engine controller according to a first embodiment.

An engine controller according to a first embodiment will now be described with reference to FIGS. 1 to 4. First, the configuration of the engine controller according to the first embodiment will be described with reference to FIG. 1. The engine controller according to the first embodiment is employed in a vehicle-mounted multi-cylinder engine 10. FIG. 1 shows only one of the multiple cylinders in the engine 10.

As shown in FIG. 1, the engine 10, in which the engine controller of each embodiment is employed, includes an air cleaner 12 for filtering out dust and the like in intake air in the most upstream section of an intake passage 11. The intake passage 11 is provided with an air flow meter 13, which detects an intake air flow rate, in a section downstream of the air cleaner 12.

The intake passage 11 is provided with a throttle valve 14 in a section downstream of the air flow meter 13. The throttle valve 14 regulates the intake air flow rate. A throttle motor 15 and a throttle sensor 16 are provided in the vicinity of the throttle valve 14. The throttle motor 15 selectively opens and closes the throttle valve 14. The throttle sensor 16 detects the opening degree of the throttle valve 14. The intake passage 11 is provided with an intake pipe pressure sensor 17 in a section downstream of the throttle valve 14. The intake pipe pressure sensor 17 detects the pressure of the intake air flowing in the section. The opening degree of the throttle valve 14 will hereafter be referred to as a throttle opening degree TA. The pressure of intake air detected by the intake pipe pressure sensor 17 will be referred to as an intake pipe pressure PM.

The intake passage 11 is provided with an injector 18 in a section downstream of the intake pipe pressure sensor 17. The injector 18 sprays fuel into intake air. The intake passage 11 is connected to a combustion chamber 20 via an intake valve 19. The combustion chamber 20 is provided with an ignition device 21, which ignites air-fuel mixture by spark discharge.

The combustion chamber 20 is connected to an exhaust passage 23 via an exhaust valve 22. The exhaust passage 23 is provided with an air-fuel ratio sensor 24 and a catalyst device 25. The air-fuel ratio sensor 24 detects the air-fuel ratio of the air-fuel mixture that has been burned in the combustion chamber 20. The catalyst device 25 purifies exhaust gas. Among the above-described components of the engine 10, the injector 18, the intake valve 19, the combustion chamber 20, the ignition device 21, and the exhaust valve 22 are provided in each of the respective cylinders.

The engine 10 is controlled by an electronic control unit 26, which serves as the engine controller. The electronic control unit 26 has an arithmetic processing circuit 27, which executes various types of calculation processes related to engine control, and a memory 28 storing programs and data for control. The electronic control unit 26 receives detection signals from the air flow meter 13, the throttle sensor 16, the intake pipe pressure sensor 17, and the air-fuel ratio sensor 24. The electronic control unit 26 also receives detection signals from a crank angle sensor 30, an accelerator pedal sensor 32, a vehicle speed sensor 33, a coolant temperature sensor 34, an intake air temperature sensor 35, and an atmospheric pressure sensor 36. The crank angle sensor 30 detects a crank angle CRNK, which is a rotational angle of a crankshaft 29. The crankshaft 29 is an output shaft of the engine 10. The accelerator pedal sensor 32 detects an acceleration pedal depression amount ACCP, which is the amount of depression of an accelerator pedal 31. The vehicle speed sensor 33 detects a vehicle speed V of the vehicle on which the engine 10 is mounted. The coolant temperature sensor 34 detects a coolant temperature THW of the engine 10. The intake air temperature sensor 35 detects an intake air temperature THA, which is the temperature of intake air drawn into the intake passage 11. The atmospheric pressure sensor 36 detects an atmospheric pressure PA.

Based on the detection signals from these sensors, the electronic control unit 26 determines operation amounts of the throttle motor 15, the injector 18, and the ignition device 21 and operates these components, thereby controlling the operating state of the engine 10. The electronic control unit 26 calculates an engine rotation speed NE from the detection results of the crank angle CRNK acquired by the crank angle sensor 30.

The electronic control unit 26 controls the amount of fuel injected by the injector 18 of each cylinder. In other words, the electronic control unit 26 performs a fuel injection amount control as part of the engine control. When performing the fuel injection amount control, the electronic control unit 26 first calculates an intake air amount introduced into each cylinder of the engine 10. Subsequently, the electronic control unit 26 divides the calculated value of the intake air amount by the stoichiometric air-fuel ratio to obtain a quotient, which is used as an instructed injection amount. The electronic control unit 26 performs the fuel injection amount control by operating the injector 18 of each cylinder to inject the amount of fuel corresponding to the instructed injection amount.

Figure 2:
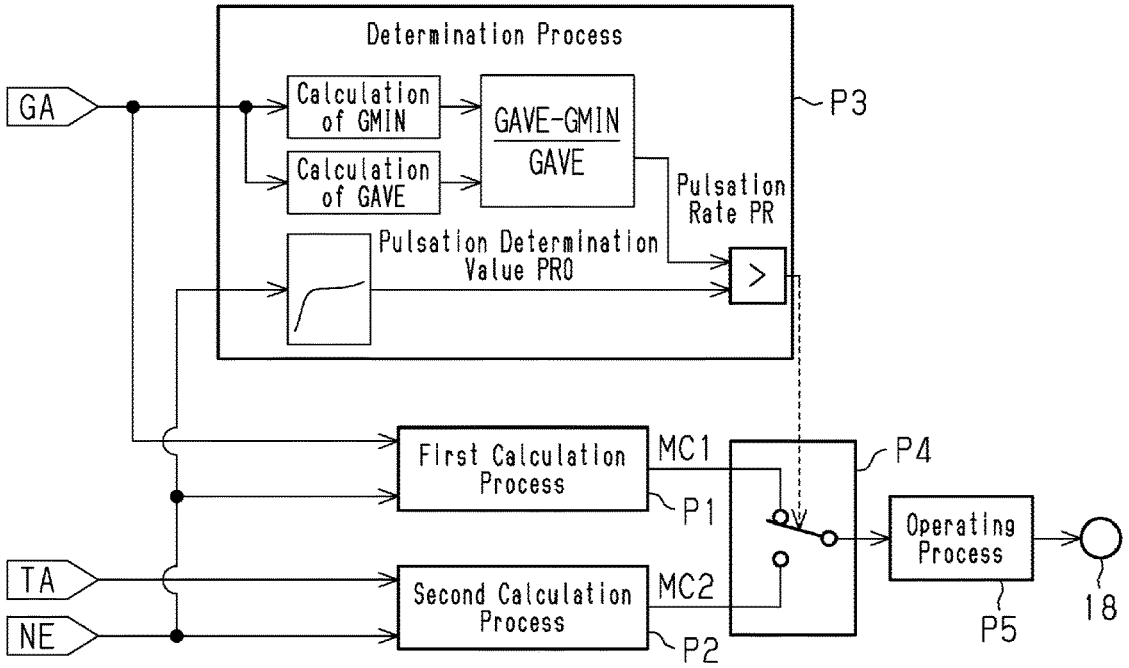
FIG. 2 is a block diagram showing flows of processes related to fuel injection amount control performed by the engine controller.

FIG. 2 shows flows of processes related to the fuel injection amount control performed by the electronic control unit 26. As shown in FIG. 2, the fuel injection amount control in the engine controller of the first embodiment is performed through a first calculation process P1, a second calculation process P2, a determination process P3, a calculation method switching process P4, and an operating process P5.

The first calculation process P1 calculates an intake air amount introduced into the cylinder of the engine 10 based on an AFM-detected flow rate GA and the engine rotation speed NE. That is, the first calculation process P1 performs calculation of the intake air amount by the mass flow method based on the output of the air flow meter 13. In the following description, the calculated value of the intake air amount obtained by the first calculation process P1 will be referred to as a first intake air amount calculated value MC1.

The second calculation process P2 performs calculation of the intake air amount based on the throttle opening degree TA and the engine rotation speed NE. That is, the second calculation process P2 performs calculation of the intake air amount by the throttle speed method based on the throttle opening degree TA. In the following description, the calculated value of the intake air amount obtained by the second calculation process P2 will be referred to as a second intake air amount calculated value MC2.

In the intake passage 11 of the engine 10, intermittent inflow of intake air into the combustion chamber 20 in response to opening and closing of the intake valve 19 generates pressure fluctuation of the intake air. The pressure fluctuation generated in response to opening and closing of the intake valve 19 is propagated upstream over the entire intake passage 11. The determination process P3 performs determination as to whether the pressure fluctuation of intake air, or the intake air pulsation at a position in the intake passage 11 where the air flow meter 13 is disposed is great. In the following description, the determination as to whether such intake air pulsation is great will be referred to as pulsation determination.

Figure 3:
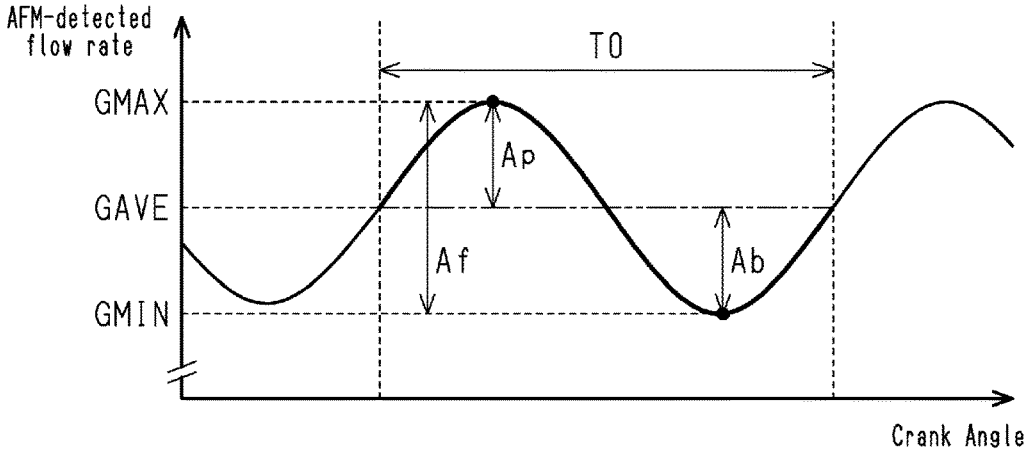
FIG. 3 is a diagram illustrating a manner in which a pulsation rate is calculated by the engine controller in a determination process.

The determination process P3 performs the pulsation determination in the following manner. The determination process P3 first obtains a minimum flow rate GMIN and an average flow rate GAVE based on the AFM-detected flow rate GA. As shown in FIG. 3, the minimum flow rate GMIN represents the minimum value of the AFM-detected flow rate GA within the period T0 of the intake air pulsation. The average flow rate GAVE represents the average value of the AFM-detected flow rate GA within the period T0 of the intake air pulsation. The values of the minimum flow rate GMIN and the average flow rate GAVE are updated for each period T0 of the intake air pulsation. In a case of a four-stroke engine, in which ignitions in the respective cylinders of one cycle are completed per two revolutions of the crankshaft 29, the period T0 of the intake air pulsation is a quotient obtained by dividing 720° CA (Crank Angle) by the number of cylinders of the engine 10.

Subsequently, the difference obtained by subtracting the minimum flow rate GMIN from the average flow rate GAVE is divided by the average flow rate GAVE. The resultant quotient is obtained as a pulsation rate PR. The determination process P3 also obtains a pulsation determination value PR0 based on the engine rotation speed NE. If the pulsation rate PR is greater than or equal to the pulsation determination value PR0, the determination process P3 determines that the intake air pulsation is great. More specifically, when the pulsation rate PR is greater than or equal to the pulsation determination value PR0, a great pulsation range determination flag, which represents the result of the pulsation determination, is set. When the pulsation rate PR is less than the pulsation determination value PR0, the great pulsation range determination flag is cleared.

As the engine rotation speed NE increases, the number of times air is introduced into each cylinder of the engine 10 per unit time increases. Simply put, the intake air amount of each cylinder is a quotient obtained by dividing the intake air flow rate by the number of times air is introduced into the cylinder per unit time. Accordingly, even if the pulsation rate PR remains the same, the error in the first intake air amount calculated value MC1 due to the influence of the pulsation rate PR increases as the engine rotation speed NE decreases. Taking this into consideration, the value of the pulsation determination value PR0 is set to be less when the engine rotation speed NE is low than when the engine rotation speed NE is high.

The calculation method switching process P4 selects one of the first intake air amount calculated value MC1 and the second intake air amount calculated value MC2 as the calculated value of the intake air amount to be delivered to the operating process P5 in accordance with the result of the pulsation determination by the determination process P3. Specifically, when the great pulsation range determination flag is in a cleared state, the first intake air amount calculated value MC1 is delivered as the calculated value to the operating process P5. When the great pulsation range determination flag is in a set state, the second intake air amount calculated value MC2 is delivered as the calculated value to the operating process P5.

The operating process P5 calculates a value of an instructed injection amount Q, which is an instructed value of the fuel injection amount of the injector 18, based on the calculated value of the intake air amount delivered from the calculation method switching process P4, and operates the injector 18 of each cylinder to inject the amount of fuel corresponding to the instructed injection amount Q. Specifically, the operating process P5 first divides the calculated value of the intake air amount delivered from the calculation method switching process P4 by the stoichiometric air-fuel ratio and uses the resultant quotient as a value of a base injection amount QBSE. Further, the instructed injection amount Q is set to a value obtained by correcting the base injection amount QBSE, for example, through air-fuel ratio feedback correction based on the detection result of the air-fuel ratio sensor 24, and the injector 18 is operated based on the value of the instructed injection amount Q.

An operation and advantages of the first embodiment will now be described.

In the intake passage 11 of the engine 10, intermittent opening of the intake valve 19 generates intake air pulsation. When such intake air pulsation increases, the detection accuracy of the air flow meter 13 is reduced due to the influence of the intake air pulsation.

To deal with such a situation, the first calculation process P1 of the first embodiment calculates the intake air amount by the mass flow method based on the output of the air flow meter 13, and the second calculation process P2 calculates the intake air amount by the throttle speed method based on the throttle opening degree TA. When the detection accuracy of the air flow meter 13 is reduced, the calculation accuracy of the intake air amount of the first calculation process P1 is also reduced. Thus, if the instructed injection amount Q of the injector 18 is determined by using the first intake air amount calculated value MC1 in the first calculation process P1 even when the intake air pulsation is great, the control accuracy of the fuel injection amount is reduced. In the first embodiment, when the intake air pulsation is small, the instructed injection amount Q is determined by using the first intake air amount calculated value MC1, which is calculated by the first calculation process P1. When the intake air pulsation is great, the instructed injection amount Q is determined by using the second intake air amount calculated value MC2, which is calculated by the second calculation process P2. As described above, in the first embodiment, the intake air amount calculation method used to determine the fuel injection amount is switched from the mass flow method to the throttle speed method when the intake air pulsation is great. This limits reduction in the control accuracy of the fuel injection amount due to an increase in the intake air pulsation.

As shown in FIG. 3, the amounts that indicate the amplitude of intake air pulsation include a whole amplitude Af, a peak-side half amplitude Ap, and a bottom-side half amplitude Ab. The whole amplitude Af of intake air pulsation represents the difference between a maximum flow rate GMAX and the minimum flow rate GMIN, which is the minimum value of the flow rate. The peak-side half amplitude Ap represents the difference between the maximum flow rate GMAX and the average flow rate GAVE. The bottom-side half amplitude Ab represents the difference between the average flow rate GAVE and the minimum flow rate GMIN. The maximum flow rate GMAX is the maximum value of the AFM-detected flow rate GA within the period T0 of the intake air pulsation.

In the first embodiment, the determination process P3 executes the pulsation determination for switching the intake air amount calculation method based on the pulsation rate PR obtained from the AFM-detected flow rate GA. As described above, the value of the pulsation rate PR is a quotient obtained by dividing the difference between the average flow rate GAVE and the minimum flow rate GMIN within the period T0 of the intake air pulsation by the average flow rate GAVE. In the first embodiment, the pulsation determination is performed by using the bottom-side half amplitude Ab of the intake air pulsation as a parameter for evaluating the amplitude of the intake air pulsation.

The whole amplitude Af and the peak-side half amplitude Ap of the intake air pulsation can be used as a parameter for evaluating the magnitude of the intake air pulsation. In the first embodiment, the bottom-side half amplitude Ab is used as a parameter for evaluating the amplitude of the intake air pulsation for the following reasons.

Figure 4:
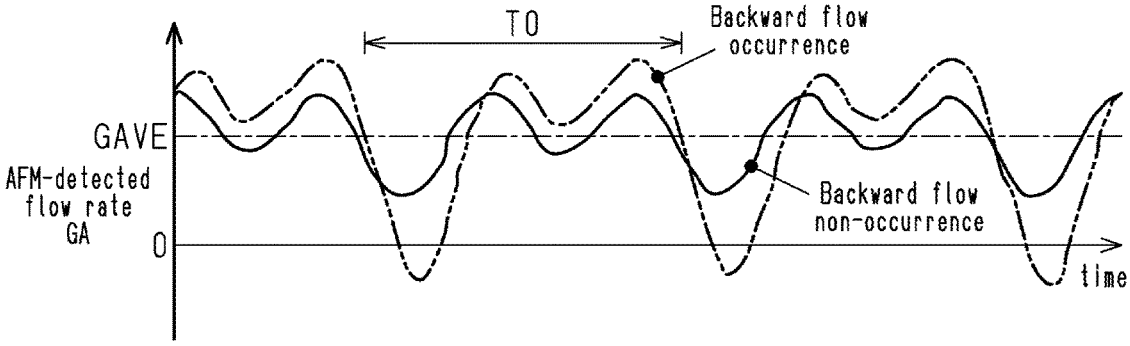
FIG. 4 is a diagram showing changes in an AFM-detected flow rate when a backward flow is occurring and when no backward flow is occurring.

The solid line in FIG. 4 represents the waveform of the AFM-detected flow rate GA when the engine 10 is operating in a range in which the AFM-detected flow rate GA does not become 0, that is, in a state in which the intake air pulsation does not reach the backward flow range. In the following description, the state in which intake air pulsation is generated within a range in which the intake air pulsation does not reach the backward flow range will be referred to as a backward flow non-occurrence state. In the backward flow non-occurrence state, if the valve timing of the intake valve 19 is retarded while regulating the throttle opening degree TA so as to maintain the engine rotation speed NE and the intake air amount at constant values, intake air pulsation increases to reach the backward flow range. The waveform of the AFM-detected flow rate GA in this situation is represented by the long dashed double-short dashed line in FIG. 4. In the following description, the state in which intake air pulsation has increased to reach the backward flow range will be referred to as a backward flow occurrence state. When the backward flow non-occurrence state is shifted to the backward flow occurrence state, the engine rotation speed NE and the intake air amount are constant, so that the average flow rate GAVE is maintained at the same value.

In the above-described configuration, the throttle opening degree TA is increased when the backward flow non-occurrence state is shifted to the backward flow occurrence state. When the throttle opening degree TA is great and the flow passage area of the intake air at the throttle valve 14 has been increased, the pressure fluctuation caused by opening and closing of the intake valve 19 is easily transmitted to the air flow meter 13. Thus, if the throttle opening degree TA is increased when the backward flow non-occurrence state is shifted to the backward flow occurrence state, the intake air pulsation increases. At an increase in the intake air pulsation, the amount of increase in the bottom-side half amplitude Ab is greater than the amount of increase in the peak-side half amplitude Ap. Thus, in the backward flow occurrence state, the bottom-side half amplitude Ab is greater than the peak-side half amplitude Ap. Therefore, among the whole amplitude Af, the peak-side half amplitude Ap, and the bottom-side half amplitude Ab, the bottom-side half amplitude Ab has the greatest increase rate when the backward flow non-occurrence state is shifted to the backward flow occurrence state.

The air flow meter 13 has output characteristics that are non-linear in relation to the intake air flow rate. The detection accuracy of the air flow meter 13 is designed to become higher in more frequently used ranges of flow rate. Since a backward flow of intake air occurs in limited circumstances, detection errors of the air flow meter 13 increase in ranges of flow rate in which the intake air flow rate has negative values, that is, in ranges of backward flow. Thus, when the whole amplitude Af, the peak-side half amplitude Ap, and the peak-side half amplitude Ap are calculated based on the AFM-detected flow rate GA, all the calculated values have errors in a situation in which the intake air pulsation has increased to reach the backward flow range. Even in this case, the bottom-side half amplitude Ab has a great increase rate in relation to the increase in the intake air pulsation. Thus, irrespective of errors, the bottom-side half amplitude Ab shows a significant increase if the intake air pulsation increases. Thus, when a situation is considered in which intake air pulsation that reaches a backward flow range is generated, the pulsation determination is properly performed by using the bottom-side half amplitude Ab, rather than the whole amplitude Af or the peak-side half amplitude Ap.

The air flow meter 13 may be a type capable of detecting the direction of the flow of intake air or a type incapable of detecting the direction of the flow of intake air flow. The latter type simply detects the intake air flow rate regardless whether the flow is a forward flow or a backward flow. The waveform of the AFM-detected flow rate GA in FIG. 4 is a waveform of an air flow meter capable of detecting the direction of an intake air flow, and the AFM-detected flow rate GA during backflow has a negative value. Also, in a case in which an air flow meter incapable of detecting the direction of a flow of intake air is employed as the air flow meter 13, the bottom-side half amplitude Ab has the greatest increase rate during the process in which the backward flow non-occurrence state is shifted to the backward flow occurrence state, among the whole amplitude Af, the peak-side half amplitude Ap, and the bottom-side half amplitude Ab. Thus, even in a situation in which an air flow meter incapable of detecting the direction of a flow of intake air is employed, pulsation determination is properly performed by using the bottom-side half amplitude Ab, rather than the whole amplitude Af or the peak-side half amplitude Ap.

The engine controller of the first embodiment has the following advantages.

(1) In the first embodiment, when intake air pulsation is determined to be not great, the first intake air amount calculated value MC1, which has been calculated by the mass flow method, is used as the calculated value of the intake air amount used in the fuel injection amount control. When the intake air pulsation is determined to be great, the second intake air amount calculated value MC2, which has been calculated by the throttle speed method, is used as the calculated value of the intake air amount used in the fuel injection amount control. Thus, when the calculation accuracy of the intake air amount by the mass flow method is reduced due to an increase in intake air pulsation, the reduction in the control accuracy of the fuel injection amount is limited.

(2) In the first embodiment, it is determined that the intake air pulsation is great when the difference between the average flow rate GAVE, which is the average value of the AFM-detected flow rate GA, and the minimum flow rate GMIN, which is the minimum value of the AFM-detected flow rate GA, is great. Thus, when intake air pulsation reaches the backward flow range, in which detection errors of the air flow meter 13 are great, the pulsation determination is performed accurately. This allows the intake air amount calculation method to be switched appropriately.

Second Embodiment

An engine controller according to a second embodiment will now be described with reference to FIG. 5. In the second embodiment and each embodiment described below, structures common to those of the first embodiment are identified by the same reference numbers and will not be described in detail.

Propagation of a pressure fluctuation of intake air via the throttle valve 14 largely depends on the throttle opening degree TA. Accordingly, frequent repetitions of small changes in the throttle opening degree TA increases and decreases the intake air pulsation frequently, resulting in frequent switching of the intake air amount calculation method. This may make the engine control unstable. In this regard, the engine controller of the second embodiment sets a hysteresis for the pulsation determination value PR0 so as to reduce the frequency of switching of the intake air amount calculation method. That is, in the second embodiment, the pulsation determination value PR0 takes two values: a setting determination value PRS, which is used when the great pulsation range determination flag is in a cleared state; and a clearing determination value PRC, which is used when the great pulsation range determination flag is in a set state. The setting determination value PRS and the clearing determination value PRC are both set based on the engine rotation speed NE.

Figure 5:
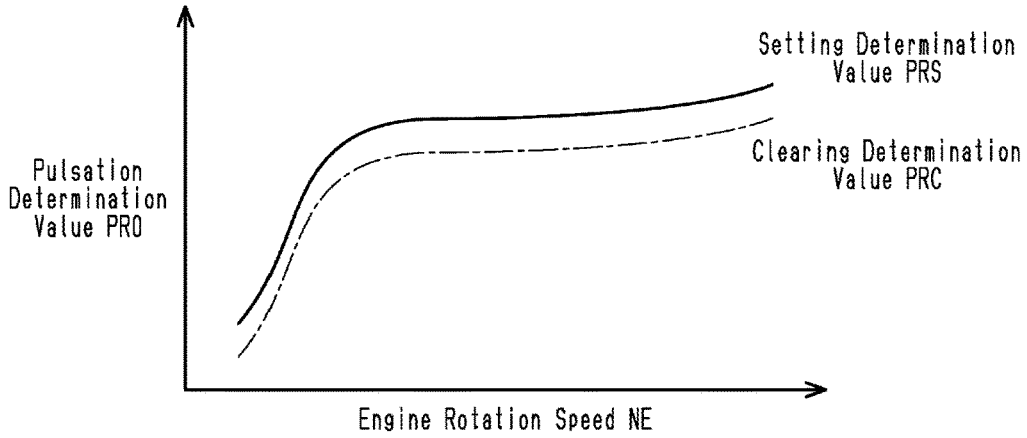
FIG. 5 is a diagram showing a manner in which a pulsation determination value of an engine controller according to a second embodiment is set.

FIG. 5 shows the relationship of the setting determination value PRS and the clearing determination value PRC with the engine rotation speed NE. The setting determination value PRS is set in the same manner in which pulsation determination value PR0 is set in the first embodiment. In contrast, as shown in FIG. 5, the clearing determination value PRC is set to be less than the setting determination value PRS at any value of the engine rotation speed NE. In the determination process P3 in the engine controller of the second embodiment executes the pulsation determination by setting the pulsation determination value PR0 to the setting determination value PRS when the great pulsation range determination flag is in a cleared state, and by setting the pulsation determination value PR0 to the clearing determination value PRC when the great pulsation range determination flag is in a set state.

The engine controller of the second embodiment has the advantages (1) and (2), which are described above. Further, since the engine controller of the second embodiment reduces the frequency of switching of the intake air amount calculation method, the engine control is easily stabilized.

Third Embodiment

An engine controller according to a third embodiment will now be described with reference to FIGS. 6 and 7.

As described above, the pulsation determination is performed based on the bottom-side half amplitude Ab in the first and second embodiments. The bottom-side half amplitude Ab is calculated as the difference between the average flow rate GAVE, which is the average value of the AFM-detected flow rate GA within the period T0 of the intake air pulsation, and the minimum flow rate GMIN, which is the minimum value of the AFM-detected flow rate GA within the period T0. The average flow rate GAVE and the minimum flow rate GMIN are updated only for each period T0 of the intake air pulsation. Therefore, a temporal delay up to the amount of time corresponding to the period T0 occurs from when the intake air pulsation actually increases until the intake air amount calculation method is switched from the mass flow method to the throttle speed method. However, the third embodiment reduces such a delay in switching of the intake air amount calculation method by performing the determination process P3 in the following manner.

Figure 6:
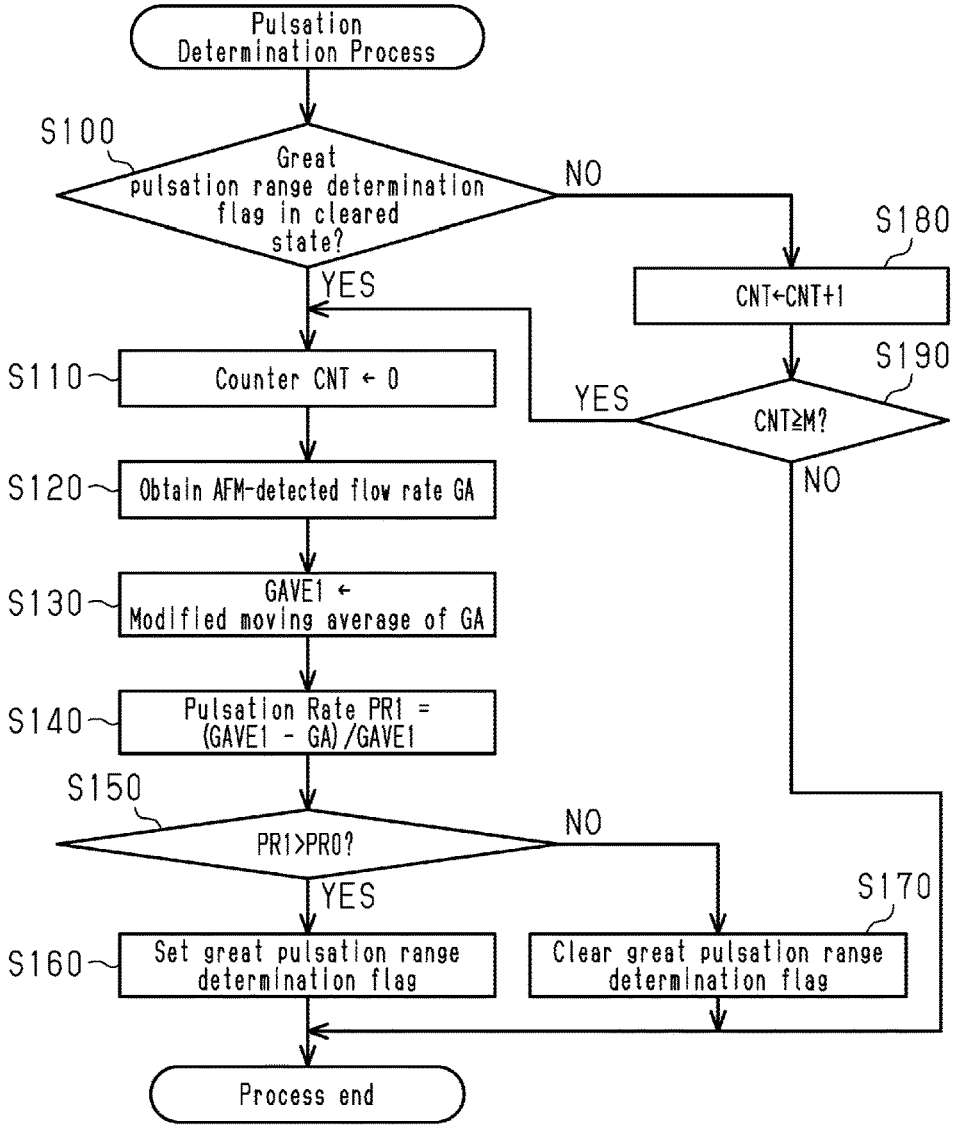
FIG. 6 is a flowchart of a pulsation determination process executed by an engine controller according to a third embodiment.

FIG. 6 is a flowchart of a pulsation determination process in the determination process P3 performed by the engine controller of the third embodiment. The electronic control unit 26 repeatedly executes the pulsation determination process shown in FIG. 6 while the engine 10 is running. An execution interval T1 of the pulsation determination process is set to a quotient obtained by dividing the period T0 of the intake air pulsation by an integer greater than 1. That is, the pulsation determination process is executed M times within the period T0 of the intake air pulsation.

When the pulsation determination process is started, it is determined in step S100 whether the great pulsation range determination flag is in a cleared state. If the great pulsation range determination flag is in a cleared state (S100: YES), the process proceeds to step S110. If the great pulsation range determination flag is in a set state (S100: NO), the process proceeds to step S180.

When the process proceeds to step S110, the value of a counter CNT is cleared to 0 in step S110. Subsequently in step S120, the value of the current AFM-detected flow rate GA is obtained. In step S130, a modified moving average MMA of the AFM-detected flow rate GA is obtained, and an average flow rate GAVE1 is set to the modified moving average MMA. The modified moving average MMA of the AFM-detected flow rate GA is obtained by updating the value using an expression (1). In the expression (1), MMA [i−1] represents the value of the modified moving average MMA before being updated, and MMA[i] represents the value of the modified moving average MMA after being updated. In the expression (1), N is a constant and is set to an integer greater than 1.

$$\mathrm{MMA}[i] \leftarrow \{(N-1)\times \mathrm{MMA}[i-1]+GA\}/N \quad (1)$$

Thereafter, in step S140, the difference obtained by subtracting the AFM-detected flow rate GA from the average flow rate GAVE1 is divided by the average flow rate GAVE1. The obtained quotient is obtained as a pulsation rate PR1. Subsequently, in step S150, it is determined whether the pulsation rate PR1 is greater than the pulsation determination value PR0. If the pulsation rate PR1 is greater than the pulsation determination value PR0 (S150: YES), the great pulsation range determination flag is set in step S160. Then, the current pulsation determination process is ended. If the pulsation rate PR1 is less than or equal to the pulsation determination value PR0 (S150: NO), the great pulsation range determination flag is cleared in step S170. Then, the current pulsation determination process is ended.

If it is determined in step S100 that the great pulsation range determination flag is in a set state (S100: NO), the process proceeds to step S180. In step S180, the value of the counter CNT is incremented by 1. Subsequently, in step S190, it is determined whether the value of the counter CNT is greater than or equal to M. If the value of the counter CNT is greater than or equal to M (S190: YES), the process proceeds to step S110. If the value of the counter CNT is less then M (S190: NO), the current pulsation determination process is ended without any further steps executed.

An operation and advantages of the third embodiment will now be described.

In the first and second embodiments, the pulsation determination is performed after a difference obtained by subtracting the minimum flow rate GMIN from the average flow rate GAVE is divided by the average flow rate GAVE, and the resultant quotient is obtained as the pulsation rate PR. However, in the third embodiment, the pulsation determination is performed by obtaining a difference by subtracting an instantaneous value of the AFM-detected flow rate GA from the average flow rate GAVE1, dividing the difference by the average flow rate GAVE1, and obtaining the quotient as the pulsation rate PR1.

As a matter of course, the instantaneous value of the AFM-detected flow rate GA never falls below the minimum flow rate GMIN, which is the minimum value of the AFM-detected flow rate GA. Thus, if the pulsation rate PR1, which has been obtained from an instantaneous value of the AFM-detected flow rate GA, exceeds the pulsation determination value PR0 even for a moment within the period T0 of the intake air pulsation, the pulsation rate PR, which has been obtained from the minimum flow rate GMIN within the period T0, naturally exceeds the pulsation determination value PR0. Therefore, the pulsation determination by using an instantaneous value of the AFM-detected flow rate GA instead of the minimum flow rate GMIN allows for determination that the intake air pulsation is great. This in turn allows the intake air amount calculation method to be switched in accordance with an increase in the intake air pulsation before the end of the period T0 of the intake air pulsation. That is, in the third embodiment, the pulsation determination is performed by confirming that the difference between the average flow rate GAVE and the minimum flow rate GMIN is great based on the fact that the difference obtained by subtracting the instantaneous value of the AFM-detected flow rate GA from the average flow rate GAVE1 has become great.

In the third embodiment, the modified moving average of the AFM-detected flow rate GA is obtained as an approximate value of the average flow rate within the period of intake air pulsation. This allows the average flow rate GAVEL to be updated each time the pulsation determination process is executed.

Figure 7:
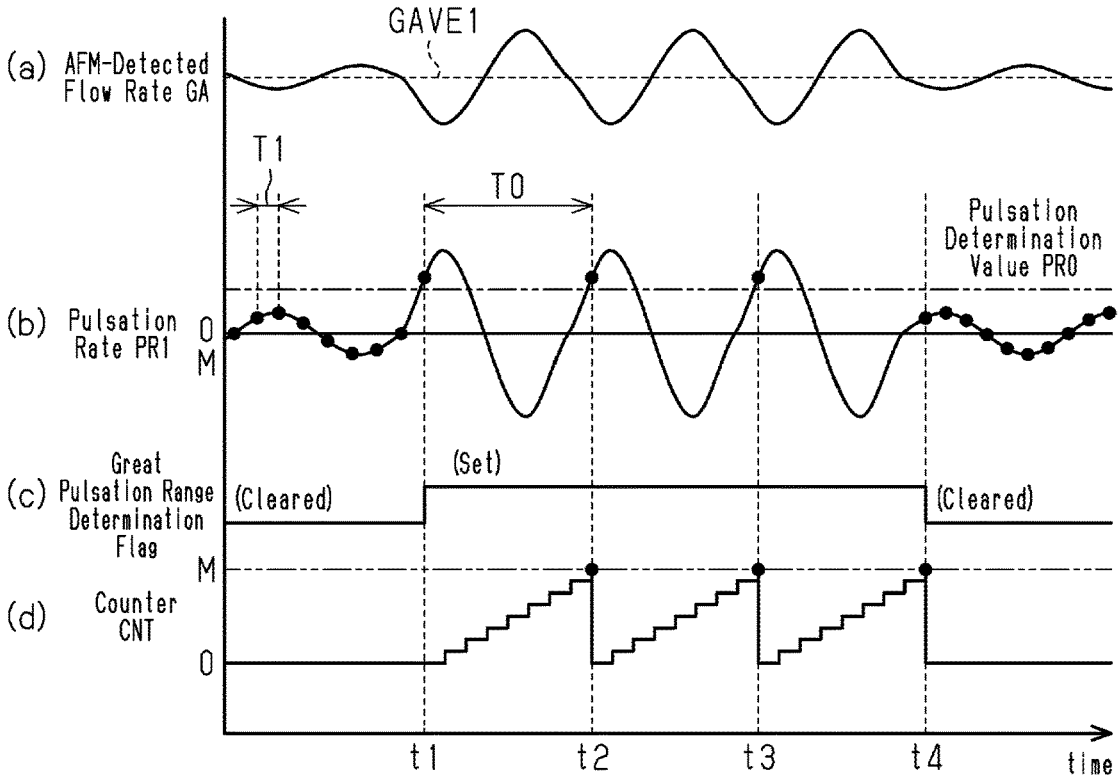
FIG. 7 is a timing diagram showing an example of a manner in which a pulsation determination is performed by the engine controller, where section (a) shows changes in an AFM-detected flow rate, section (b) shows changes in a pulsation rate, section (c) shows changes in a great pulsation range determination flag, and section (d) shows changes in the value of a counter.

FIG. 7 shows an example of a manner in which the pulsation determination according to the third embodiment is performed. In FIG. 7, section (a) shows changes in the AFM-detected flow rate GA, section (b) shows changes in the pulsation rate PR1, section (c) shows changes in the great pulsation range determination flag, and section (d) shows changes in the value of the counter CNT. The dots on the curve in section (b) of FIG. 7, which represents changes in the pulsation rate PR1, represent times at which the pulsation determination process is executed based on the pulsation rate PR1.

During the time period before a point in time t1 in FIG. 7, the great pulsation range determination flag is in a cleared state. During this time period, the value of the counter CNT is maintained at 0. Each time the pulsation determination process is executed, that is, at each execution interval T1, the calculation of the pulsation rate PR (S130, S140) based on the AFM-detected flow rate GA at that point in time, or an instantaneous value of the AFM detected flow rate GA, and the pulsation determination (S150) based on the pulsation rate PR are performed.

In FIG. 7, the amount of change of the AFM-detected flow rate GA, that is, the intake air pulsation, increases from immediately before the point in time t1. As described above, in the third embodiment, the pulsation rate PR1 is obtained by using the instantaneous value of the AFM-detected flow rate GA instead of the minimum flow rate GMIN, and it can be determined that the intake air pulsation is great before the minimum flow rate GMIN within the period T0 of the intake air pulsation is fixed. In the case of FIG. 7, the pulsation rate PR1 exceeds the pulsation determination value PR0 at the point in time t1, so that the great pulsation range determination flag is switched from a cleared state to a set state.

As described above, when the great pulsation range determination flag is in a set state, the value of the counter CNT is incremented by 1 each time the pulsation determination process is executed. In the pulsation determination process, if the great pulsation range determination flag is in a set state (S100: NO) and the value of the counter CNT is less than M (S190: NO), the process is ended without performing the substantive pulsation determination (S150). As described above, the execution interval T1 of the pulsation determination process is set to a quotient obtained by dividing the period T0 of the intake air pulsation by M, so that the time period required for the counter CNT to increase from 0 to M is equal to the period T0 of the pulsation determination. Thus, during the time period from when the great pulsation range determination flag is set to when the period T0 of the intake air pulsation elapses, the determination in step S150 in the pulsation determination process is suspended. That is, the performance of the pulsation determination is suspended.

Thus, at a point in time t2, at which an amount of time corresponding to the period T0 of the intake air pulsation has elapsed, the counter CNT has increased to M (S190: YES). Accordingly, the pulsation determination in step S150 of the pulsation determination process is executed. The value of the pulsation rate PR1, which is obtained based on an instantaneous value of the AFM-detected flow rate GA, increases or decreases in synchronization with the period T0 of the intake air pulsation. Thus, the point in time t2 is time at which the pulsation rate PR1 has increased in the increase-decrease period of the pulsation rate PR1. This is because the pulsation rate PR1 has increased at the point in time t1, which precedes the point in time t2 by the amount of time corresponding to the period T0.

In the case of FIG. 7, the pulsation rate PR1 exceeds the pulsation determination value PR0 also at the point in time t2 (S150: YES), so that the great pulsation range determination flag remains in a set state. The value of the counter CNT is cleared to 0 at this point in time (S110), and is then incremented by 1 each time the pulsation determination process is executed (S180). Therefore, while the great pulsation range determination flag remains in a set state (S100: NO), the pulsation determination based on the pulsation rate PR1 (S150) is executed at each period T0 of the pulsation determination.

At a point in time t3 in the case of FIG. 7, the amount of time corresponding to the period T0 of the intake air pulsation has elapsed from the point in time t2. At a point in time t4, the amount of time corresponding to the period T0 of the intake air pulsation has elapsed from the point in time t3. The great pulsation range determination flag remains in a set state from the point in time t2 to the point in time t4 (S100: NO). The intake air pulsation has decreased during the time period from the point in time t3 to the point in time t4. At the point in time t4, at which the pulsation determination is performed for the first time after the decrease, the great pulsation range determination flag is switched from a set state to a cleared state (S100: YES).

In addition to the above-described advantages (1) and (2), the third embodiment has the following advantage.

(3) It is possible to promptly determine a state in which the intake air pulsation is small has been changed to a state in which the intake air pulsation is great. This shortens the time period in which the calculation accuracy of the intake air amount is reduced by an increase in the intake air pulsation, and the control accuracy of the fuel injection amount is reduced, accordingly.

Fourth Embodiment

An engine controller according to a fourth embodiment will now be described with reference to FIG. 8. The engine controller of the fourth embodiment has the same configuration as the engine controller of the third embodiment except that a forced determination ending process, which will be discussed below, is additionally executed in the determination process P3.

The engine controller of the third embodiment is capable of promptly performing determination of a change from a state in which the intake air pulsation is small to a state in which the intake air pulsation is great. However, since the pulsation determination is performed at each period T0 during a time period in which it is determined that the intake air pulsation is great, a temporal delay up to the amount of time corresponding to the period T0 of the intake air pulsation may occur in the determination that a great intake air pulsation has changed to a small intake air pulsation. In this regard, the engine controller of the fourth embodiment executes the forced determination ending process in the determination process P3, thereby limiting a delay in determination that a state in which the intake air pulsation is great has been changed to a state in which the intake air pulsation is small.

Figure 8:
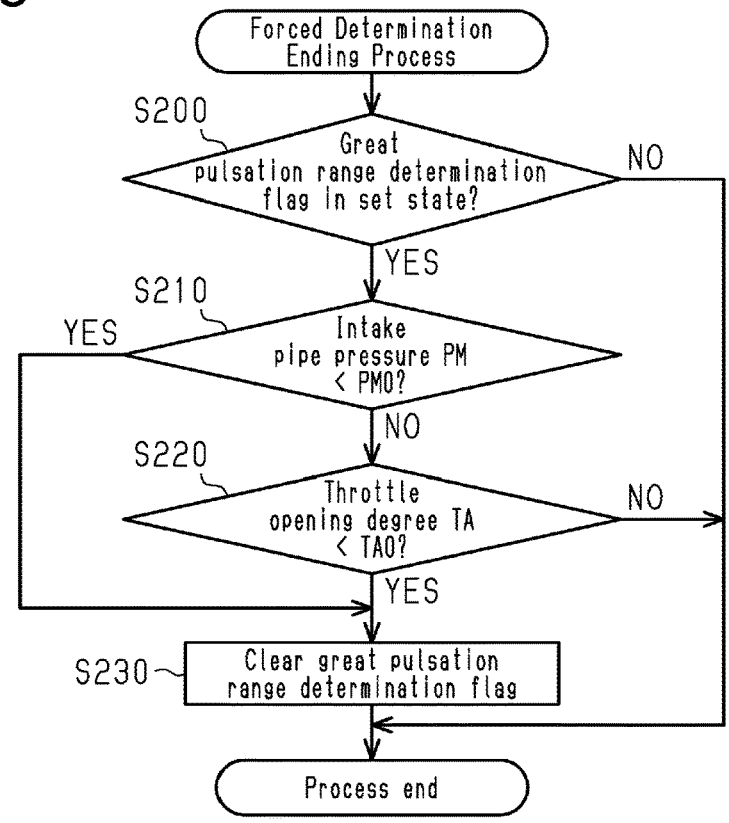
FIG. 8 is a flowchart of a forced determination ending process executed by an engine controller according to a fourth embodiment.

FIG. 8 shows a flowchart of the above-described forced determination ending process. This process is repeatedly executed by the electronic control unit 26 at predetermined intervals while the engine 10 is running.

When this process is started, it is determined in step S200 whether the great pulsation range determination flag is in a set state. If the great pulsation range determination flag is in a set state (S200: YES), the process proceeds to step 210. If the great pulsation range determination flag is in a cleared state (S200: NO), the current forced determination ending process is ended without any further steps executed.

When the process moves to step S210, it is determined in step S210 whether the intake pipe pressure PM is less than a prescribed low pressure determination value PM0. If the intake pipe pressure PM is less than the low pressure determination value PM0 (S210: YES), the process proceeds to step S230. If the intake pipe pressure PM is more than or equal to the intake pipe pressure PM (S210: NO), the process proceeds to step S220.

When the process proceeds to step S220, it is determined in step S220 whether the throttle opening degree TA is less than a prescribed small opening degree determination value TA0. If the throttle opening degree TA is smaller than the small opening degree determination value TA0 (S220: YES), the process proceeds to step S230. If the throttle opening degree TA is greater than or equal to the small opening degree determination value TA0, the forced determination ending process is ended without any further steps executed.

When the process proceeds to step S230, the great pulsation range determination flag is cleared in step S230. Thereafter, the current forced determination ending process is ended.

An operation and advantages of the fourth embodiment will now be described.

When the throttle opening degree TA is small, the pressure fluctuation of the intake air does not easily pass through the throttle valve 14, resulting in a small intake air pulsation. Thus, intake air pulsation great enough to reduce the calculation accuracy of the first intake air amount calculated value MC1 occurs only in a state in which the throttle opening degree TA is greater than a certain amount of opening degree. In contrast, when the throttle opening degree TA is reduced, the intake pipe pressure PM is reduced. Thus, intake air pulsation great enough to reduce the calculation accuracy of the first intake air amount calculated value MC1 occurs only in a state in which the intake pipe pressure PM is more than a certain pressure.

In this regard, in the fourth embodiment, the small opening degree determination value TA0 is set to the lower limit of the range of the throttle opening degree TA in which intake air pulsation occurs that is great enough to reduce the calculation accuracy of the first intake air amount calculated value MC1. Also, the above-described low pressure determination value PM0 is set to the lower limit of the range of the intake pipe pressure PM in which intake air pulsation occurs that is great enough to reduce the calculation accuracy of the first intake air amount calculated value MC1. If the intake pipe pressure PM drops below the low pressure determination value PM0 (S210: YES) when the great pulsation range determination flag is in a set state (S200: YES), of if the throttle opening degree TA drops below the small opening degree determination value TA0, the great pulsation range determination flag is cleared immediately (S230). Thus, when the throttle opening degree TA is suddenly reduced to zero, for example, at a rapid deceleration, it is possible to promptly determine that a state in which the intake air pulsation is great has been changed to a state in which the intake air pulsation is small before the pulsation determination based on the pulsation rate PR1, which is performed at each period T0 of the intake air pulsation.

In addition to the above-described advantages (1) and (2), the fourth embodiment has the following advantage.

(4) It is possible to promptly determine a state in which the intake air pulsation is great has been changed to a state in which the intake air pulsation is small.

Fifth Embodiment

Figure 9:
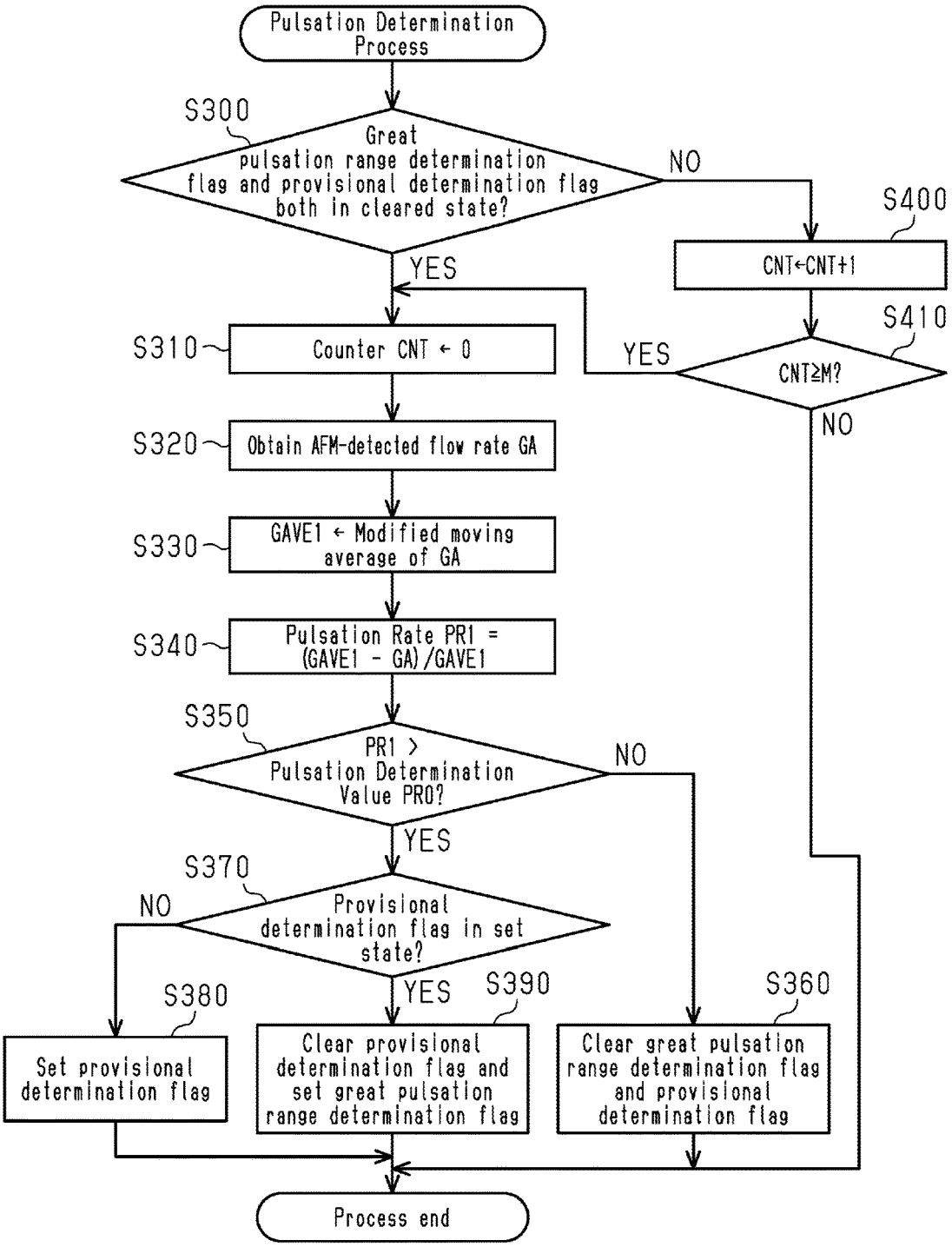
FIG. 9 is a flowchart of a pulsation determination process executed by an engine controller according to a fifth embodiment.

An engine controller according to a fifth embodiment will now be described with reference to FIG. 9. The engine controller of the fifth embodiment executes the pulsation determination process in the engine controller of the third embodiment in the manner shown in FIG. 9. In the fifth embodiment, the pulsation determination process is executed by the electronic control unit 26 at the same interval as that in the third embodiment.

When the pulsation determination process is started, it is determined in step S300 whether the great pulsation range determination flag and a provisional determination flag are both in a cleared state. If the great pulsation range determination flag and the provisional determination flag are both in a cleared state (S300: YES), the process proceeds to step S310. If at least one of the great pulsation range determination flag and the provisional determination flag is in a set state (S300: NO), the process proceeds to step S400.

When the process proceeds to step S310, the value of the counter CNT is cleared to 0 in step S310. Subsequently in step S320, the value of the current AFM-detected flow rate GA is obtained. In step S330, a modified moving average MMA of the AFM-detected flow rate GA is obtained, and an average flow rate GAVE1 is set to the modified moving average MMA. Thereafter, in S340, the difference obtained by subtracting the AFM-detected flow rate GA from the average flow rate GAVE1 is divided by the average flow rate GAVE1. The obtained quotient is obtained as a pulsation rate PR1. Subsequently, in step S350, it is determined whether the pulsation rate PR1 is greater than the pulsation determination value PR0. If the pulsation rate PR1 is less than or equal to the pulsation determination value PR0 (S350: NO), the great pulsation range determination flag is cleared in step S360. Then, the current pulsation determination process is ended. If the pulsation rate PR1 is greater than the pulsation determination value PR0 (S350: YES), the process proceeds to step S370.

When the process proceeds to step S370, it is determined in step S370 whether the provisional determination flag is in a set state. If the provisional determination flag is in a cleared state (S370: NO), the provisional determination flag is set in step S380. Then, the current process of the routine is ended. If the provisional determination flag is in a set state (S370: YES), the provisional determination flag is cleared and the great pulsation range determination flag is set in step S390. Then, the current pulsation determination process is ended.

If it is determined in step S300 that at least one of the great pulsation range determination flag and the provisional determination flag is in a set state (S300: NO), the process proceeds to step S400. In step S400, the value of the counter CNT is incremented by 1. Subsequently, in step S410, it is determined whether the value of the counter CNT is greater than or equal to M. If the value of the counter CNT is greater than or equal to M (S410: YES), the process proceeds to step S310. If the value of the counter CNT is less than M (S410: NO), the current pulsation determination process is ended without any further steps executed.

As in the third embodiment, the engine controller of the fifth embodiment performs the pulsation determination by using an instantaneous value of the AFM-detected flow rate GA, instead of the minimum flow rate GMIN. However, the instantaneous value of the AFM-detected flow rate GA may be temporarily calculated as a value less than the actual value, for example, due to influence of noise. Thus, it may be erroneously determined that the intake air pulsation is great.

In this regard, in the fifth embodiment, when the pulsation rate PR1 exceeds the pulsation determination value for the first time (S350: YES, S370: NO), only the provisional determination flag is set while maintaining the great pulsation range determination flag in a cleared state (S380). If the pulsation rate PR1 has again exceeded the pulsation determination value when the period T0 of the intake air pulsation elapses (S350: YES, S370: YES), the great pulsation range determination flag is set (S390). That is, in the fifth embodiment, when the pulsation rate PR1 remains above the pulsation determination value over two periods of the intake air pulsation (S370: YES), it is determined that the intake air pulsation is great (S390).

In addition to the above-described advantages (1) to (3), the fifth embodiment has the following advantage.

(5) When the pulsation rate PR1 remains above the pulsation determination value over two periods of intake air pulsation, it is determined that the intake air pulsation is great. Since temporary erroneous determination caused by influence of noise seldom lasts over two periods of intake air pulsation, erroneous pulsation determination caused by influence of noise is limited.

The above-described embodiments may be modified as follows. The above-described embodiments and the following modifications can be combined as long as the combined modifications remain technically consistent with each other.

In the first and second embodiments, the average flow rate GAVE, which is used in the pulsation determination, is obtained as a simple average of the AFM-detected flow rate GA within the period of intake air pulsation. In the third to fifth embodiments, the average flow rate GAVE1, which is used in the pulsation determination, is obtained as a modified moving average of the AFM-detected flow rate GA. The manners in which the average flow rates GAVE, GAVE1 are calculated may be changed as appropriate as long as the average value of the intake air flow rate within the period of the intake air pulsation can be calculated, or as long as an approximate value of the average value of the intake air flow rate within the period of the intake air pulsation can be calculated. For example, the average flow rate GAVE, which is used in the pulsation determination in the first and second embodiments, may be obtained as a modified moving average of the AFM-detected flow rate GA.

A hysteresis as used in the second embodiment may be applied to the pulsation determination value used in the pulsation determination by the engine controllers of the third to fifth embodiments.

In some cases, the minimum flow rate GMIN is temporarily calculated as a value less than the actual value due to influence of noise. Thus, even in a case of the fifth embodiment, in which the pulsation determination is performed using the minimum flow rate GMIN, erroneous pulsation determination caused by influence of noise is limited by determining that the intake air pulsation is great when the pulsation rate PR remains above the pulsation determination value over two periods of the intake air pulsation.

In the forced determination ending process of the fourth embodiment, the great pulsation range determination flag is switched from a set state to a cleared state when one of the following conditions is met: the intake pipe pressure PM being less than the low pressure determination value PM0; and the throttle opening degree TA being smaller than the small opening degree determination value TA0. The present disclosure is not limited to this. That is, the great pulsation range determination flag may be switched from a set state to a cleared state when both of the following conditions are met: the intake pipe pressure PM being less than the low pressure determination value PM0; and the throttle opening degree TA being smaller than the small opening degree determination value TA0. Of steps S210 and S220 of FIG. 8, only step S210 may be omitted, so that the forced determination ending process is executed based only on the throttle opening degree TA. Alternatively, only step S220 of FIG. 8 may be omitted, so that the forced determination ending process is executed based only on the intake pipe pressure PM.

In the first and second embodiments, the difference between the average flow rate GAVE and the minimum flow rate GMIN is divided by the average flow rate GAVE, and the resultant quotient is obtained as the pulsation rate PR. The pulsation determination is performed by determining whether the pulsation rate PR exceeds the pulsation determination value. That is, the pulsation determination is performed by determining that the state in which the magnitude of the intake air pulsation relative to the intake air flow rate exceeds the pulsation determination value is a state in which the intake air pulsation is great. However, for example, when the sheer magnitude of the intake air pulsation causes a problem, the pulsation determination may be performed by determining whether the difference between the average flow rate GAVE and the minimum flow rate GMIN exceeds the pulsation determination value. Likewise, the pulsation determination in the third to fifth embodiments may be performed by determining whether the difference obtained by subtracting an instantaneous value of the AFM detected GA from the average flow rate GAVE1 exceeds the pulsation determination value.

The second calculation process P2 of each of the above-described embodiments calculates the intake air amount by the throttle speed method. However, the intake air amount may be calculated by the speed density method based on the detected value of the intake pipe pressure PM. Even in such a case, the second calculation process P2 calculates the intake air amount without the output of the air flow meter 13. Thus, if the calculated value of the intake air amount of the second calculation process P2 is used as the calculated value of the intake air amount used to determine the instructed injection amount Q of the injector 18 at the time when the intake air pulsation is great, reduction in the control accuracy of the fuel injection amount due to an increase in the intake air pulsation is limited.

In each of the above-described embodiments, the calculation method switching process P4 selects one of the first intake air amount calculated value MC1 and the second intake air amount calculated value MC2 as the calculated value of the intake air amount, and the selected calculated value is used to determine the instructed injection amount Q of the injector 18. The calculated value of the intake air amount selected by the calculation method switching process P4 may be used to determine the operation amount of an actuator provided in the engine 10 other than the injector 18. The operation amount of the actuator may be an instructed value of the throttle opening degree TA delivered to the throttle motor 15 or an instructed value of the ignition timing delivered to the ignition device 21. In addition, the operation amount of the actuator may be an instructed value of the valve timing delivered to a variable valve timing mechanism 19A, an instructed value of the recirculated amount of exhaust gas delivered to the EGR device, or an instructed value of the released amount of fuel vapor delivered to the vapor purge mechanism.

The electronic control unit 26 is not limited to a device that includes the arithmetic processing circuit 27 and the memory 28 and executes various types of software processing. For example, at least part of the processes executed by the software in the above-described embodiments may be executed by hardware circuits dedicated to executing these processes (such as ASIC). That is, the electronic control unit may be modified as long as it has any one of the following configurations (a) to (c). (a) A configuration including a processor that executes all of the above-described processes according to programs and a program storage device such as a ROM (including a non-transitory computer readable memory medium) that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing devices each including a processor and a program storage device and a plurality of dedicated hardware circuits may be provided.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An engine controller used for an engine, the engine including an air flow meter that detects an intake air flow rate in an intake passage, the engine controller operating an actuator installed in the engine, thereby controlling operation of the engine, and the engine controller being configured to execute:

a first calculation process that calculates an intake air amount introduced into a cylinder of the engine, based on a detection result of the air flow meter;

a second calculation process that calculates the intake air amount based on at least one of a detected value of an intake pipe pressure and a throttle opening degree, without using the detection result of the air flow meter;

a determination process that determines whether an intake air pulsation is great based on the intake air flow rate detected by the air flow meter, the determination process determining that the intake air pulsation is great if it is confirmed that a difference between an average flow rate and a minimum flow rate is great, the average flow rate being an average value of the intake air flow rate within a period of the intake air pulsation, and the minimum flow rate being a minimum value of the intake air flow rate within the period; and a calculation method switching process, wherein when the determination process does not determine that the intake air pulsation is great, the calculation method switching process selects a calculated value of the intake air amount that is obtained by the first calculation process as an intake air amount calculated value used to determine an operation amount of the actuator, and when the determination process determines that the intake air pulsation is great, the calculation method switching process selects a calculated value of the intake air amount that is obtained by the second calculation process as the intake air amount calculated value used to determine the operation amount of the actuator, wherein the determination process confirms that the difference between the average flow rate and the minimum flow rate is great if a difference obtained by subtracting an instantaneous value of the intake air flow rate detected by the air flow meter from the average flow rate is great, wherein the instantaneous value is obtained within the period of intake air pulsation.

2. The engine controller according to claim 1, wherein, after determining that the intake air pulsation is great, the determination process determines that the intake air pulsation is not great if the throttle opening degree falls below a prescribed small opening degree determination value.

3. The engine controller according to claim 1, wherein, after determining that the intake air pulsation is great, the determination process determines that the intake air pulsation is not great if the intake pipe pressure falls below a prescribed low pressure determination value.

4. The engine controller according to claim 1, wherein, when the difference between the average flow rate and the minimum flow rate remains great over two periods of the intake air pulsation, the determination process determines that the intake air pulsation is great.

5. An engine controller used for an engine, the engine including an air flow meter that detects an intake air flow rate in an intake passage, the engine controller operating an actuator installed in the engine, thereby controlling operation of the engine, and the engine controller being configured to execute:

a first calculation process that calculates an intake air amount introduced into a cylinder of the engine based on a detection result of the air flow meter;

a second calculation process that calculates the intake air amount based on at least one of a detected value of an intake pipe pressure and a throttle opening degree, without using the detection result of the air flow meter;

a determination process that determines whether an intake air pulsation is great based on the intake air flow rate detected by the air flow meter, the determination process determining that the intake air pulsation is great if it is confirmed that a difference between an average flow rate and a minimum flow rate is great, the average flow rate being an average value of the intake air flow rate within a period of the intake air pulsation, and the minimum flow rate being a minimum value of the intake air flow rate within the period; and a calculation method switching process, wherein when the determination process does not determine that the intake air pulsation is great, the calculation method switching process selects a calculated value of the intake air amount that is obtained by the first calculation process as an intake air amount calculated value used to determine an operation amount of the actuator, and when the determination process determines that the intake air pulsation is great, the calculation method switching process selects a calculated value of the intake air amount that is obtained by the second calculation process as the intake air amount calculated value used to determine the operation amount of the actuator, wherein the determination process obtains, as a value of a pulsation rate, a quotient obtained by dividing the difference between the average flow rate and the minimum flow rate by the average flow rate, and the determination process determines that the intake air pulsation is great if the pulsation rate exceeds a prescribed pulsation determination value.

6. An engine control method used for an engine including an air flow meter that detects an intake air flow rate in an intake passage, the engine control method operating an actuator installed in the engine, thereby controlling operation of the engine, the engine control method comprising:

calculating an intake air amount introduced into a cylinder of the engine based on a detection result of the air flow meter;

calculating the intake air amount based on at least one of a detected value of an intake pipe pressure and a throttle opening degree, without using the detection result of the air flow meter;

determining whether an intake air pulsation is great based on the intake air flow rate detected by the air flow meter, wherein it is determined that the intake air pulsation is great if it is confirmed that a difference between an average flow rate and a minimum flow rate is great, the average flow rate being an average value of the intake air flow rate within a period of the intake air pulsation, and the minimum flow rate being a minimum value of the intake air flow rate within the period; and selecting a calculated value of the intake air amount used to determine an operation amount of the actuator, wherein when it is not determined that the intake air pulsation is great, a calculated value of the intake air amount that is obtained based on the detection result of the air flow meter is selected as the calculated value used to determine the operation amount of the actuator, and when it is determined that the intake air pulsation is great, a calculated value of the intake air amount that is obtained based on at least one of the detected value of the intake pipe pressure and the throttle opening degree is selected as the calculated value used to determine the operation amount of the actuator, wherein determining whether an intake air pulsation is great includes confirming that the difference between the average flow rate and the minimum flow rate is great if a difference obtained by subtracting an instantaneous value of the intake air flow rate detected by the air flow meter from the average flow rate is great, wherein the instantaneous value is obtained within the period of intake air pulsation.

7. A non-transitory computer readable medium that stores a program that causes a processor to execute an engine control process, the engine control process being used for an engine including an air flow meter that detects an intake air flow rate in an intake passage, the engine control process operating an actuator installed in the engine, thereby controlling operation of the engine, the engine control process including:

calculating an intake air amount introduced into a cylinder of the engine based on a detection result of the air flow meter;

calculating the intake air amount based on at least one of a detected value of an intake pipe pressure and a throttle opening degree, without using the detection result of the air flow meter;

determining whether an intake air pulsation is great based on the intake air flow rate detected by the air flow meter, wherein it is determined that the intake air pulsation is great if it is confirmed that a difference between an average flow rate and a minimum flow rate is great, the average flow rate being an average value of the intake air flow rate within a period of the intake air pulsation, and the minimum flow rate being a minimum value of the intake air flow rate within the period; and selecting a calculated value of the intake air amount used to determine an operation amount of the actuator, wherein when it is not determined that the intake air pulsation is great, a calculated value of the intake air amount that is obtained based on the detection result of the air flow meter is selected as the calculated value used to determine the operation amount of the actuator, and when it is determined that the intake air pulsation is great, a calculated value of the intake air amount that is obtained based on at least one of the detected value of the intake pipe pressure and the throttle opening degree is selected as the calculated value used to determine the operation amount of the actuator, wherein determining whether an intake air pulsation is great includes confirming that the difference between the average flow rate and the minimum flow rate is great if a difference obtained by subtracting an instantaneous value of the intake air flow rate detected by the air flow meter from the average flow rate is great, wherein the instantaneous value is obtained within the period of intake air pulsation.

* * * * *